US008540509B1

(12) United States Patent
Cantal

(10) Patent No.: US 8,540,509 B1
(45) Date of Patent: Sep. 24, 2013

(54) INDOOR AND OUTDOOR HEATER

(76) Inventor: Dante Cantal, Cerritos, CA (US)

( * ) Notice: Subject to any disclaimer, the term of this patent is extended or adjusted under 35 U.S.C. 154(b) by 98 days.

(21) Appl. No.: 13/374,309

(22) Filed: Dec. 21, 2011

Related U.S. Application Data

(63) Continuation-in-part of application No. 12/070,428, filed on Feb. 19, 2008, now abandoned.

(51) Int. Cl.
*F23D 3/40* (2006.01)

(52) U.S. Cl.
USPC ..... 431/328; 431/329; 431/326; 431/7

(58) Field of Classification Search
USPC ..... 431/328, 329, 280, 76, 7; 137/601.19, 137/599.14, 601.14; 251/110
See application file for complete search history.

(56) References Cited

U.S. PATENT DOCUMENTS 3,424,146 A 1/1969 Patrick et al.
3,954,387 A 5/1976 Cooper
5,643,544 A 7/1997 Henkelmann
6,109,912 A * 8/2000 Robinson et al. ..... 431/247
6,470,687 B1 10/2002 Kendall
6,971,871 B2 12/2005 Ahmady
7,497,386 B2 * 3/2009 Donnelly et al. ..... 236/15 BG
2005/0247303 A1 * 11/2005 Weiss et al. ..... 126/504

* cited by examiner

*Primary Examiner* — Alfred Basichas

(74) *Attorney, Agent, or Firm* — Charles C. H. Wu; Maria Erlinda Co. Sarno

(57) ABSTRACT

An indoor-outdoor gas infrared heater having one or more heat level settings. The heater includes a burner having ceramic plaques with a plurality of perforations and raised surfaces tapering into an apex between the perforations and an operating system having a control module electrically connected to a control valve, a power source and an activator for triggering the heater. The control valve has multiple pathways with each pathway supplying gas to the burner at a flow rate for a designated heat level setting. The heater has compartments for protecting the components from the heat coming from the burner.

20 Claims, 10 Drawing Sheets

INDOOR AND OUTDOOR HEATER

This is a continuation-in-part application of Ser. No. 12/070,428 filed on Feb. 19, 2008 now abandoned which is hereby incorporated by reference.

This invention relates to an indoor-outdoor gas infrared heater that can have multiple heat level settings having all burner plaques active at all times at each heat level setting.

BACKGROUND

Gas infrared heaters includes a porous combustion surface usually made of ceramic plaques where a gaseous fuel and air mixture burns on the surface of the plaques. Current heaters only have one heat level setting. Consequently, at least two or more heaters are needed, one for each indoor enclosed area which usually requires less heat, consequently set at a low heat level setting and one for an open outdoor area with an open traffic which is usually set at a high heat level. In both heaters, there is no flexibility in adjusting the heat outside its temperature rating to conform with the temperature of the environment which at times requires less heat than other times. Further, a user may temporarily require more heat such as when dividing walls are opened to expand the room, for example for big gatherings. It would be desirable for example, in banquet rooms that can be subdivided into smaller rooms or expanded into a bigger room to have heaters with multiple heat level settings to conform with the size of the room thereby making it not only comfortable but also energy saving by not emitting more radiant heat than necessary when a smaller room is used. The present invention solved the above inability to provide multiple heat level settings by careful consideration of different factors and combining the right burner material, control valve and other components in a carefully designed housing, assembled in such a way that it can deliver heat at one or multiple levels or settings.

Other gas infrared heaters that have both high and low heat level settings achieved this through a burner control valve that distributes gas to selected number of burner plaques. This system is also referred to as burner or plaque selection system. Heat is controlled by the number of plaques receiving gas and burning at its surface thereby giving off radiant heat proportional to the number of active plaques. Active plaques mean plaques burning gas-air mixture at its surface. On a low heat level setting, not all of the plaques are active and on a high heat level setting, almost all or all of the plaques are active. While this design and assembly provide flexibility in terms of over-all heat, the radiant heat is not emitted uniformly throughout all of the plaques at all times since some of the plaques are purposely shut-off when less radiant heat is needed. Likewise, since some plaques are active and some are not, an enclosure or area will not have uniform heating, resulting in some spots near the active plaques getting more heat than another spot farther from an active plaque or burner.

Present infrared gas heaters have only two compartments, one for the burner and one for the operating system. This is adequate to shield and separate them apart when the burner is turned "on" because cold air enters from the outside into the operating system compartment and mixes with the gas at the inlet tube of the burner but this does not take the precaution of protecting the operating system from the heat coming from the burner after it is turned "off" after usage.

It is therefore an object of this invention to provide a heater having fully fired burner plaques at all times at each heat level settings.

It is also an object of this invention to provide a method for controlling the emitted radiant heat not by burner or plaque selection but by combining the right control valve, control module and the right kind of plaque design and material that would emit low or high heat using all the plaques of the burner at all times.

It is a further object of this invention to provide a gas infrared heater with a length longer than 48 inches to cover a wider area.

It is still a further object of this invention to provide a heater activated with a remote control rather than a manual switch.

It is also still a further object of this invention to provide a heater that can be fully operated by a battery or by a standard electrical power outlet alone or by a combination of a standard electrical power outlet using an AC adapter and battery to ensure operation even during power outage.

It is also still a further object of this invention to provide a heater that has minimal component overheating and minimal warping and discoloration even after usage.

SUMMARY

The invention is on an indoor-outdoor gas infrared heater having one or more heat level settings, comprising a a chassis having a burner compartment housing a burner in a burner housing, the burner having ceramic plaques with a plurality of perforations having a total pore area of 0.1-0.2 square inches per square inch of plaque surface area and raised surfaces between the perforations, the raised surfaces tapering into an apex, the burner housing having one lateral end open to allow a burner inlet tube to protrude and plaques having insulation placed around the side peripheral edges of each plaque laid planarly side by side on top of the burner housing, the burner housing attached only to a heat shield end of the chassis and the burner inlet tube of the burner housing located opposite the heat shield end left unattached but supported by a seat bracket having a central opening allowing movement of the burner inlet tube therethrough to allow the burner housing to contract and expand during the process of heating and cooling of the plaques; an operating system compartment separated from the burner compartment housing an operating system including a control module electrically connected to a control valve having a main valve connector to the burner and a connector to a pilot assembly, a power source and an activator for triggering the heater, the control valve operating at a low voltage having multiple pathways with each pathway including an orifice having a diameter rated according to a heat input on the heater, the orifices controlling the amount supplied and designating the type of gas flowing into the burner at a flow rate for a designated heat level setting, a converter stem to ensure delivery of a correct manifold pressure by the control valve for the type of gas used. The operating system compartment is separate from the compartment for the burner and is designed to prevent heat coming from the burner to circulate and heat the components of the operating system when the burner is turned "on" and when the burner is turned "off". This heater can have a length greater than the conventional 48 inches. Both burner compartment and operating system compartments are inside a chassis.

The compartment for the burner is recommended to be lined to protect the chassis from warping, discoloration, and overheating due to excessive heat emanating from the burner, and the compartment for the operating system should be insulated from the burner and the pilot assembly, for example, by having an insulation board along the divider between the burner and the operating system compartment. In addition to this, unique to this heater, is an operating system compartment divider to further shield the control valve, the control module and the power source from being directly exposed to the inlet tube of the burner which emanates heat when the burner is turned "off" after usage, as well as provide a flue kicker underneath the burner inlet tube to assist in directing the flow of the heat coming from the burner housing through the inlet tube upwards through the holes on the access door of the operating system compartment after the burner is turned "off". When the burner is turned "off", the hot gas-air mixture inside the burner housing is pushed out through the burner inlet tube by the pressure from the gas-air mixture inside the housing instead of flowing through the plaques because the diameter of the opening of the burner inlet tube is larger than those of the passageway through the plaques thereby providing the path of least resistance. Additionally, since the gas-air mixture is not being burned at the surface of the plaques, the flow of the gas-air mixture is not directed towards the surface of the plaques because there is no void created at these surfaces to pull the gas-air mixture through the passageway which is present when the gas-air mixture is being burned. These divider and flue kicker protect the components of the operating system from the heat built up and emanating from the burner inside the burner housing after the burner is turned "off". There is no need for these insulators and flow director when the burner is "on" because the area around the inlet tube of the burner which is protruding from the burner compartment into the operating system compartment is cold due to the cold air entering from the outside into the operating system compartment. This cold air mixes with the gas at the burner inlet tube into the burner housing inside the burner compartment. The gas-air mixture inside the burner housing is burned at the surface of the ceramic plaques which heats the environment around the burning plaques and does not flow back to the burner housing.

Both compartments have covers that have a plurality of holes, the operating system compartment has an access door with a plurality of holes to allow air into the operating system while the burner cover is constructed like an eggcrate to prevent ready access to the burner and the pilot burner of the pilot assembly as well as reflect radiant heat and deflect wind.

It is recommended to construct the chassis by bordering this with two longitudinal side panels and two lateral side panels having a height greater than the height of the two longitudinal side panels to result into a flue when the bottom panel is connected to the protruding lateral side panels. The lateral side panels additionally have louvers to allow air to ventilate the heater. Stiffeners are usually but not necessarily placed on the longitudinal side panels opposite a front opening for the burner to provide extra strength and support for the chassis. It is also recommended to line the burner compartment with a liner covering at least ¾ of the burner housing to provide protection to the chassis from the heat of the burner. Installation of liners result into enclosed air spaces around the periphery of the chassis to shield this from overheating due to the heat coming from the burner.

The burner includes an inlet tube and the pilot assembly includes a pilot burner, with the inlet tube and the pilot burner each having a venturi to allow air and gas to mix for complete combustion of the gases. The plaques are high porosity bonded refractory ceramic fibre made primarily of an aluminum-silicate material. They support a wide range of heat input for the heat level setting of the heater, for example, a low level heat setting has a range of 15,000 to 35,000 Btu and a high heat level setting has a range of 25,000 to 60,000 Btu on a heater with a two heat level settings. Additionally, they have a high heat input and a high thermal shock resistance reaching approximately 1600 degrees Fahrenheit equilibrium radiant heat output within approximately 60 seconds after ignition of the burner. The ceramic plaques are lightweight and porous, glowing within 10 seconds after ignition. They should be designed to have raised surfaces, for example, pyramidal or conical in shape.

The heater operates with either natural gas or liquid propane. The converter stem ensure delivery of a correct manifold pressure for the gases which for natural gas is approximately 5 inches of water column and approximately 10 inches of water column for liquid propane. The control valve leads to a conduit for a pilot burner of the pilot assembly and a conduit for the burner. The heater can be powered solely by a battery thereby removing the need of electrical installation to operate the heater because the control valve can operate with less than 9 volts of battery power. Other gas infrared heaters require a higher voltage because of a wrong choice or selection of the control valve to use. The power can also be supplied solely from a standard electrical power outlet or by a combination of power from a battery and a standard electrical power outlet. The heater can be activated with a wireless remote control or an external switch. The control module of the heater has a temperature sensor to shut down the operation when the surrounding temperature exceeds a set temperature.

The pilot assembly comprises a pilot spark electrode for igniting a pilot flame; a pilot flame rectifier sensor for detecting a flame and causing the control valve to shut off the gas flow to the burner when a flame is not detected or to allow gas to flow to the burner when a flame is detected; and, a pilot burner having a collector hood for splitting a spark generated flame to the pilot flame rectifier sensor to the burner.

A process of operating an indoor-outdoor gas infrared heater with multiple heat level settings having a burner comprising ceramic plaques with raised surfaces tapering into an apex between perforations wherein gas flows into, a pilot flame rectifier sensor shutting the gas flow when the pilot fails to detect a flame within 60 seconds after the activator is placed to the 'ON' position and an operating system including a control module electrically connected to a control valve operating at a low voltage having a main valve connector to the burner, a connector to a pilot assembly and multiple pathways with each pathway supplying gas to the burner at a flow rate for a designated heat level setting, a power source and an activator for triggering the heater, the heater shutting off when the temperature of the control module exceeds a designated temperature, comprising triggering the heater by placing the activator to an 'ON' position; receiving a signal for ignition by the control module of the heater; sending the signal to the control valve by the control module electrically connected to the control valve; allowing a gas to flow through a conduit to a pilot burner in the pilot assembly by the control valve; sending a signal to a spark electrode of the pilot assembly to ignite a flame at the pilot burner simultaneous to the control valve allowing gas to flow through the conduit to the pilot burner; mixing the gas with air and allowing this to burn at the pilot burner; splitting the flame at the pilot burner by a gas collector hood on the pilot burner, one towards a pilot flame rectifier sensor and the other towards a main infrared burner; detecting a flame by the pilot flame rectifier sensor and signaling a main burner actuator inside the control valve to open the gas flow through a conduit of the main infrared burner; lighting the ceramic plaques on the burner after the burner receives the flow and type of gas designated for a high heat level setting; adjusting the heat level setting to another heat level setting or maintaining the high heat level setting; and, shutting the heater off when heating is no longer needed by placing the activator to an 'OFF' position. The gas flow is shut off when the pilot flame rectifier sensor fails to detect a flame within 60 seconds after the activator is placed to the 'ON' position and the heater shuts off when the surrounding temperature exceeds a designated temperature.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWING

Aspects of the present invention are illustrated by way of example, and not by way of limitation, in the accompanying drawings, wherein.

DETAILED DESCRIPTION OF THE INVENTION

The detailed description represented herein is not intended to represent the only way or the only embodiment in which the claimed invention may be practiced. The description herein is provided merely as an example or examples or illustrations of the claimed invention and should not be construed as the only way or as preferred or advantageous over other embodiments or means of practicing the invention. A heater having multiple heat level settings employing the combination of parts and assembled in the same or similar manner as described herein is within the scope of this invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to avoid obscuring the main concepts of the invention.

The use of the terms "comprise", "comprises", "comprising" and the like means that a collection of objects or parts is not limited to those objects or parts specifically recited.

Figures 1, 1A:
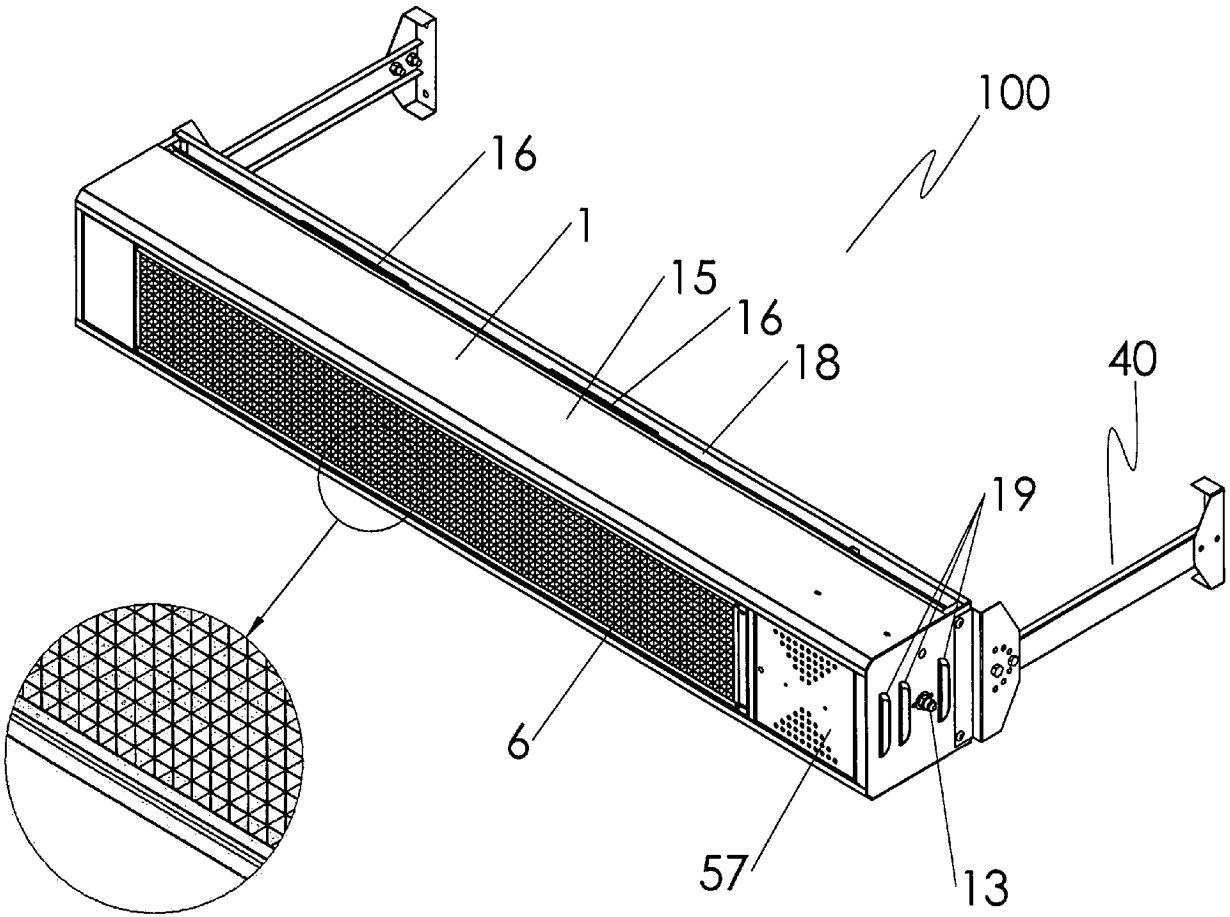
FIG. 1 is a perspective view of an indoor-outdoor heater constituting an exemplary embodiment of the invention.
FIG. 1A is a detailed view of the eggcrate design of the burner cover.
Figures 2, 2A:
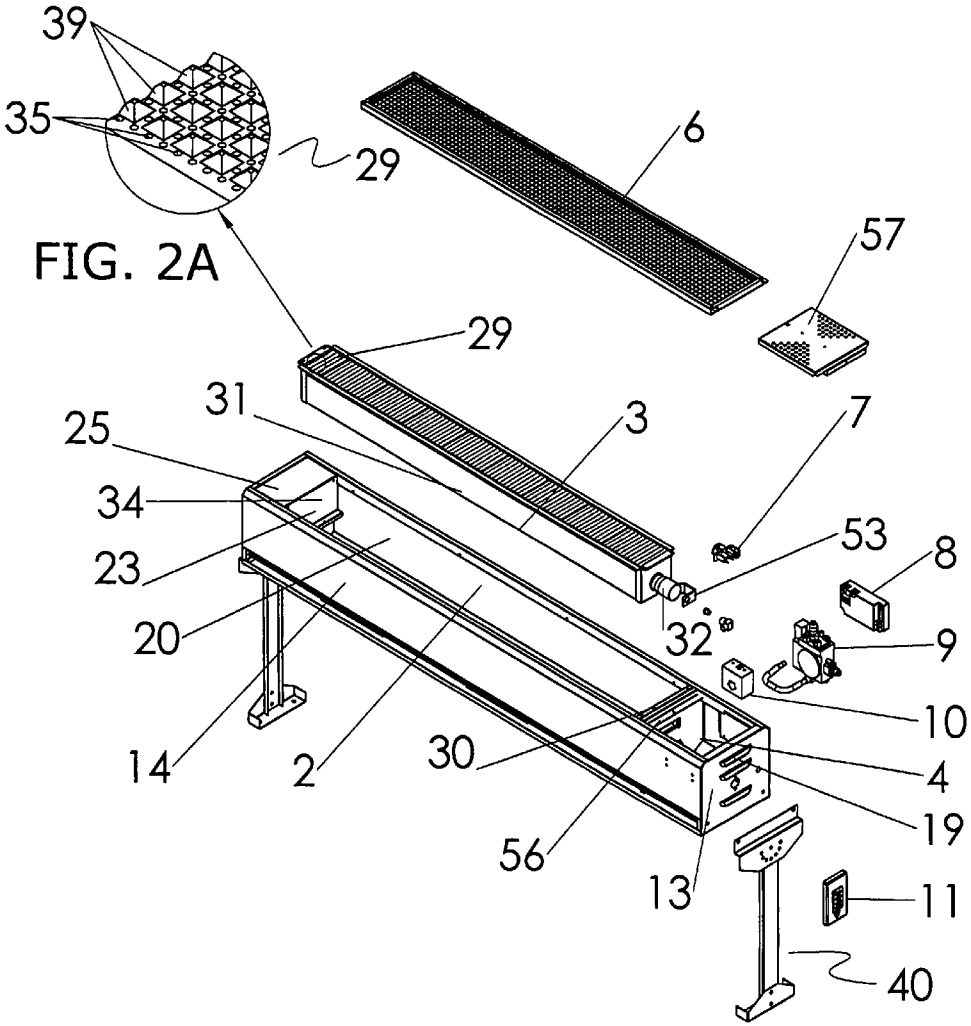
FIG. 2 shows the typical components of the indoor-outdoor heater example shown in FIG. 1.
FIG. 2A is a detailed view of a plaque.

FIG. 1 is a perspective view of an example of a gas infrared indoor-outdoor heater 100 using the teachings of this invention. The gas infrared indoor-outdoor heater is subsequently referred to herein simply as heater. FIG. 2 shows the typical components of the heater illustrated in FIG. 1. The heaters come in varying length but most heaters are 48 inches long or less. The claimed invention has allowed fabrication of heaters longer than 48 inches with careful design and choice of components. The main components of the heater are a chassis 1, housing the components of the heater, usually having separate compartments, one compartment 2 for the burner 3 and a second compartment 4 for the operating system 5; a burner 3 comprising of plaques made of high porosity bonded refractory ceramic fibre primarily of aluminum-silicate material; a burner chamber cover 6 on compartment 2; a pilot assembly 7; a control module 8; a control valve 9; a power source 10; and an activator or switch 11. The operating system 5 comprises the control module, control valve, pilot assembly, power source and activator or switch.

Figure 3:
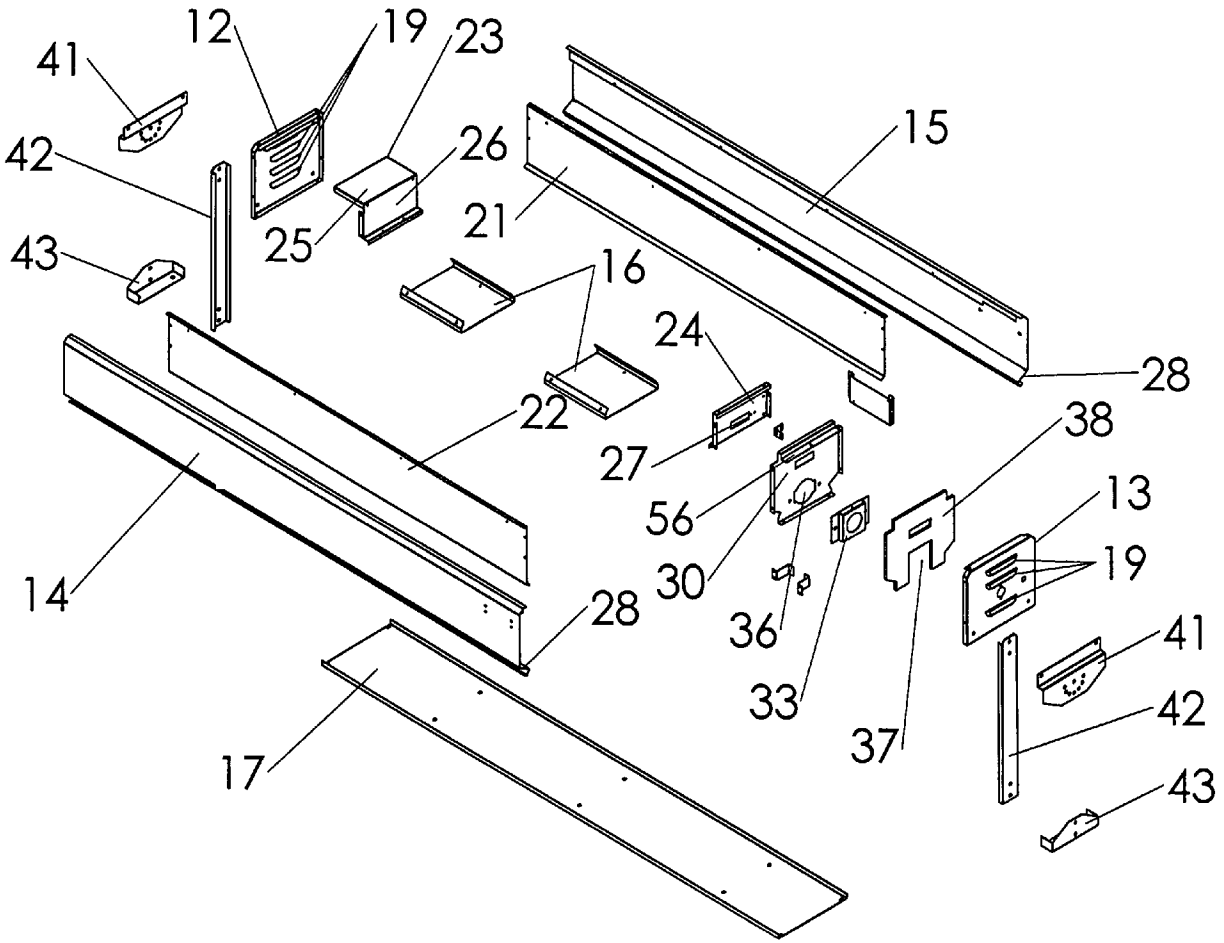
FIG. 3 is a dismantled chassis of the indoor-outdoor heater shown in FIG. 2.
Figure 4:
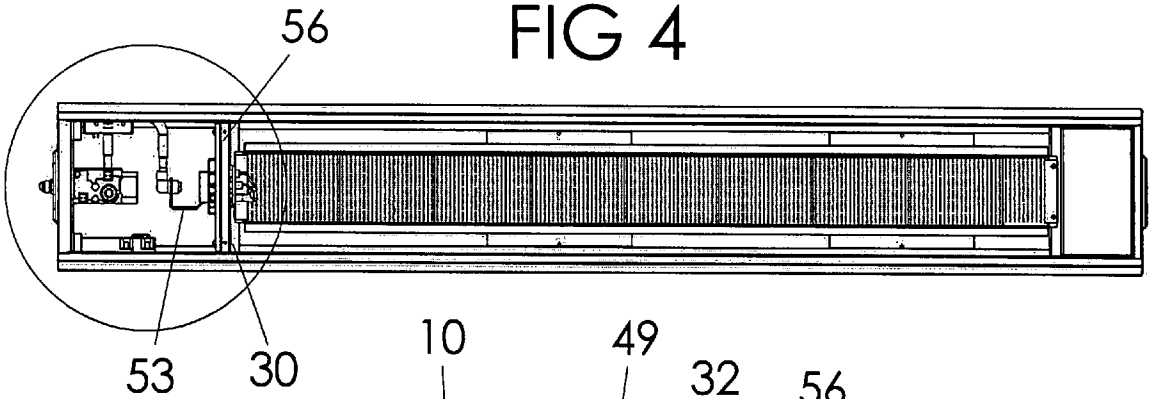
FIG. 4 is a top view showing the operating system inside an undivided operating system compartment.
Figure 4A:
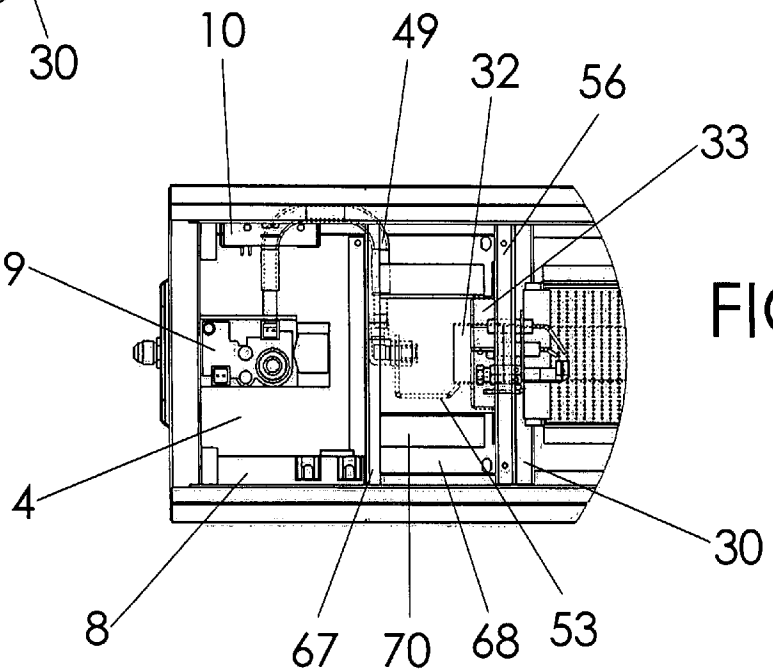
FIG. 4A is a top view showing the operating system inside a divided operating system compartment with the case divider not obscuring the connection and position of the air venturi bracket which as assembled, is covered by the case divider and the insulation board.
Figure 4C:
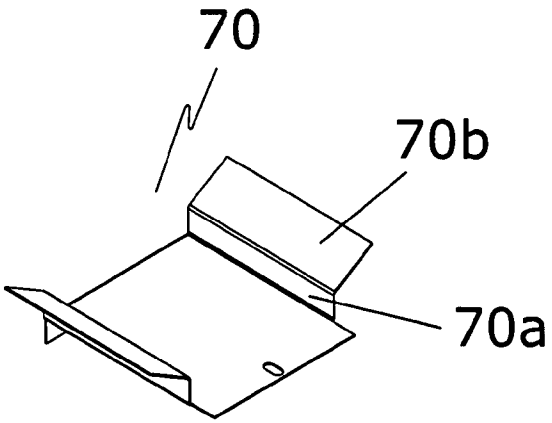
FIG. 4C shows an isolated flue kicker.
Figure 4B:
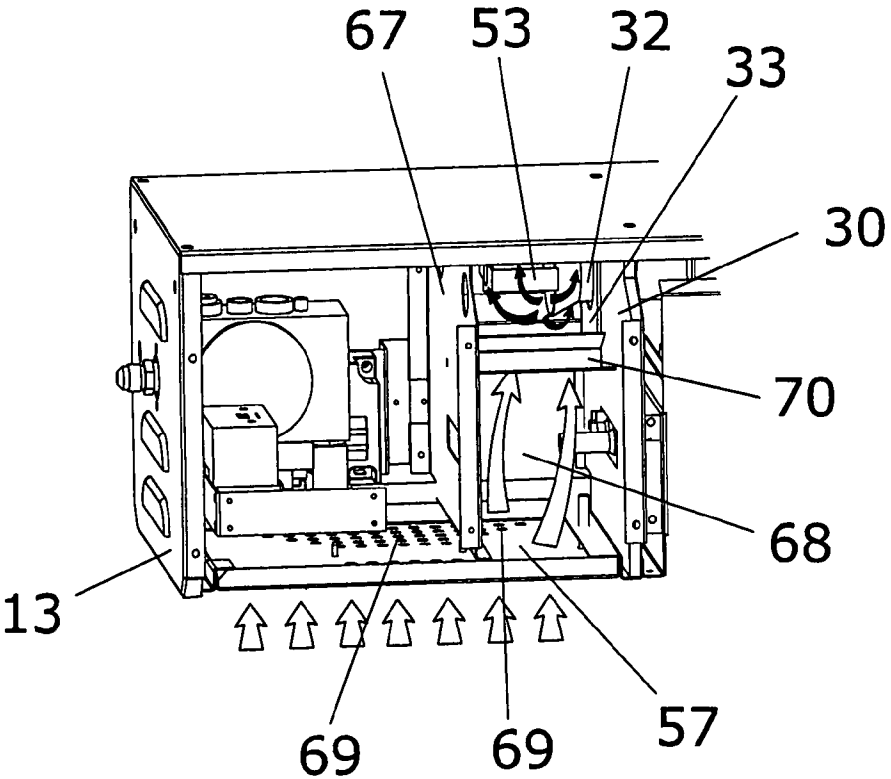
FIG. 4B is a perspective view of a divided operating system compartment with a flue kicker on the additional compartment formed by the additional divider and the flow of the hot gas-air mixture shown by arrows through this additional compartment.

For purposes of description only and not reflecting on the orientation of the heater as it is used, the assembly of the heater shown as example, will be described according to the exploded view shown in FIGS. 2 and 3 with the chassis, consequently the heater, facing up. The chassis 1 is formed by connecting or joining the lateral side panels 12 and 13 with the longitudinal side panels 14 and 15. Stiffeners or supports 16 are placed at the bottom of the longitudinal side panels 14 and 15. The lateral side panels 12 and 13 have a height greater than the height of the longitudinal side panels 14 and 15 and are assembled with the peripheral top edges of the lateral side panels and the longitudinal side panels aligning with each other. Since the height of the lateral side panels are greater, these leave the bottom of the side panels, 12 and 13 protruding from the bottom peripheral edges of the longitudinal side panels 14 and 15. Consequently, when the bottom panel 17 is connected to the lateral side panels 12 and 13, a flue 18 is created from the resulting space between the bottom peripheral edges of the longitudinal side panels and the bottom panel. Louvers 19 are provided on each side of the lateral side panels to allow air to ventilate the heater. A dismantled chassis is shown in FIG. 3. A liner 20 is placed around the burner compartment 2 to protect the chassis from the effects of the excessive heat emanating from the burner. The liner comprises two longitudinal side panels 21 and 22 of a length sufficient to accommodate the burner 3, shorter than the longitudinal side panels 14 and 15, joined together by lateral side brackets 23 and 24. The top of the liners 21 and 22 align with the top of the burner housing 31 or it should cover at least ¾ of the burner housing to provide better protection from the burner's heat. Lateral side bracket 23 as shown in FIG. 3, has a flat top 25 extending at a right angle from the lateral side wall 26 while the lateral side bracket 24 has no top but includes an elongated cut 27 to accommodate a pilot assembly which will be described later. The flat top 25 on side bracket 23 results into an enclosed air space between the lateral side panel 12 and the lateral side wall 26 of bracket 23 when joined together. The lateral inside protruding edges 28 of the longitudinal side panels 14 and 15 connect with the liner 20 to form a space between the liner and the chassis. This space lessens the heat transferred to the outside walls of the heater. The compartment 2 after the installation of the liner on chassis 1, is sufficient to house the burner 3. The stiffeners or supports 16 placed on the bottom of the longitudinal side panels 14 and 15 provide extra strength and support on the chassis, particularly the burner compartment, during the expansion and contraction of the chassis 1 during the operation of the heater. The number of stiffeners can vary based on the length of the burner compartment and the method used to attach the parts together. A case divider 30 is installed on the lateral side of bracket 24 forming the two compartments 2 and 4. Heaters in the market segregates the burner from the operating system to keep the latter away from the heat coming from the burner. However, no further partitioning is done on the operating system compartment because it stays relatively at room temperature while the burner is "on". These heaters do not consider the condition inside the compartments after the burner has just been turned "off". This heater 100 took into consideration the conditions inside the compartments especially on the components within the compartments. It was found that the operating system compartment 4 gets heated when the burner is turned "off" just after usage which consequently affects the physical condition and the performance of the components of the operating system. To prolong the life of the components of the operating system, the operating system compartment 4 is further divided by an operating system compartment divider 67 as shown in FIG. 4A to keep the components segregated from the heat coming from the burner housing after the burner is turned off. FIG. 4 in contrast shows the operating system compartment without the compartment divider 67 thereby exposing the operating system directly to the burner inlet 32. After the burner is turned off, pressure is built up by the hot gas-air mixture inside the burner housing 31 which then escapes through the burner inlet 32 into the operating system compartment. If there is no divider within the operating system compartment, the hot gas-air mixture from the burner housing will heat the components of the operating system every time the heater is turned "off" after usage. This heat is sufficient to melt or warp the casing of the power source or the control module, especially if it is made of plastic material, after repeated usage of the heater, causing these to eventually malfunction. Compartment divider 67 is shaped like the case divider 30 as shown in FIG. 4B. After the compartment divider is installed, a third compartment 68 is formed. Compartment 68 is referred to herein as the burner venturi compartment. The operating system compartment after the division will still house the control valve, control module, power source and activator. The burner venturi compartment acts like a funnel because through its construction, hot gas-air mixture from the burner housing escaping from the burner inlet tube, is directed to flow upwards as shown by the arrows, as cold air enters from the outside through the holes 69 of the access door 57 and pushes it upwards. To further prevent the hot gas-air mixture from heating the operating system components, a flue kicker 70 is attached beneath a seat bracket 33 used for holding the inlet tube 32 of the burner as shown in FIG. 4B. FIG. 4C shows an isolated flue kicker. The flue kicker 70 is shaped like a pan with two longitudinal sides 70*a* having flared up top sections 70*b* to also direct the flow of the hot gas-air mixture coming from the burner housing, upwards. As shown in FIGS. 4A and 4B, there is a space between the longitudinal sides' top sections 70*b* of the flue kicker 70 and the longitudinal side walls of the chassis to allow cold air coming from the outside through the holes 69 of the access door to flow upward and mix with the hot gas-air mixture and push this out of the compartment as stated above. One lateral end of the flue kicker is attached to the compartment divider 67 while the other end situates underneath bracket 33. A flow of the hot gas-air mixture upward through the funneling effect of the burner venturi compartment will lessen the amount of heat blocked by the compartment divider 67 and consequently more easily maintain the operating system at or near room temperature. The components of the operating system do not last long without the compartment divider and the flue kicker. A flue kicker without the compartment divider is not sufficient to shield the components from the heat emanating from the burner. A compartment divider without the flue kicker will result in some hot air flowing upwards while some hot air flow downwards through the holes 69 of the access door. The hot air flowing downwards through the holes 69 underneath the burner venturi compartment will not be prevented from reentering the holes 69 underneath the operating system compartment.

Figure 6:
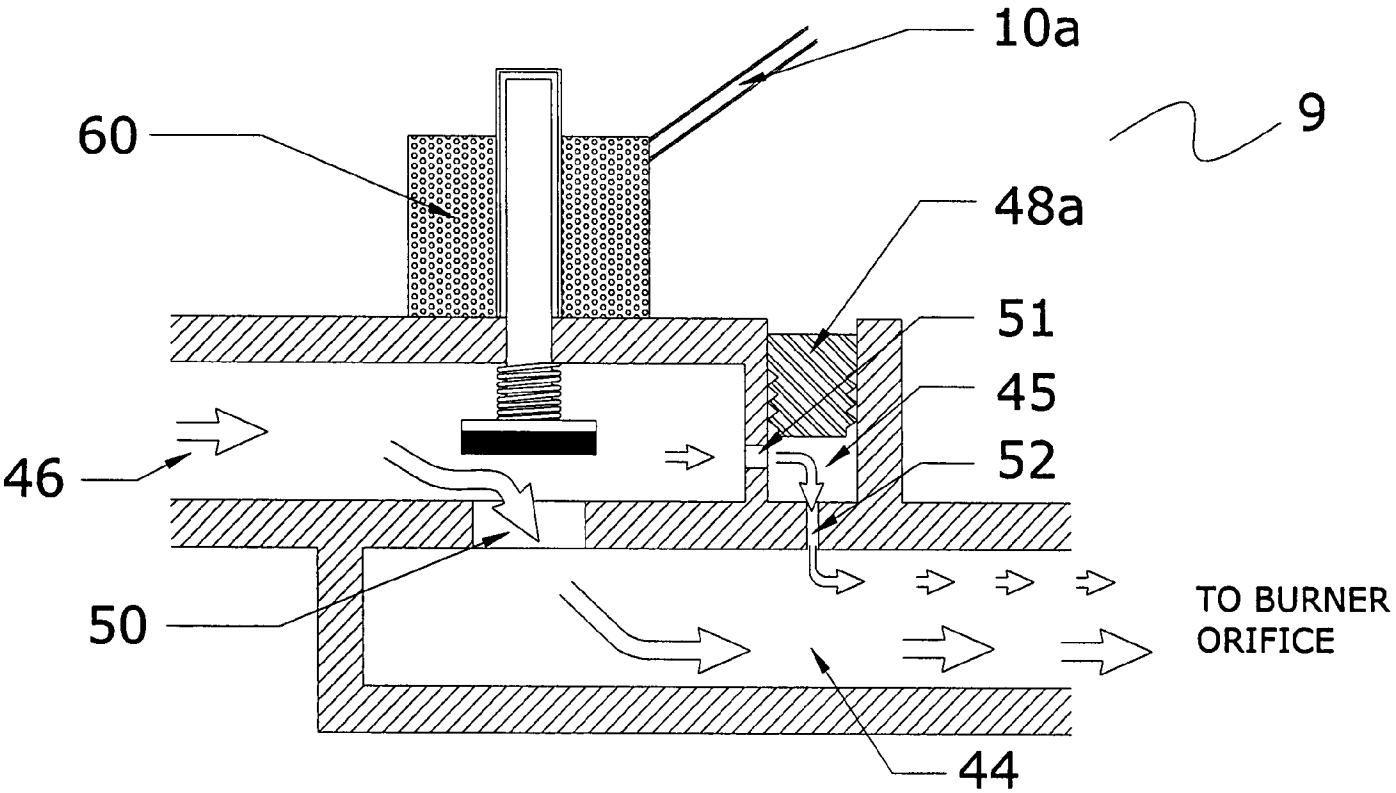
FIG. 6 is a simplified schematic showing the two pathways within a dual stage control valve with both the main pathway and the by-pass pathway open for gas passage.
Figure 6A:
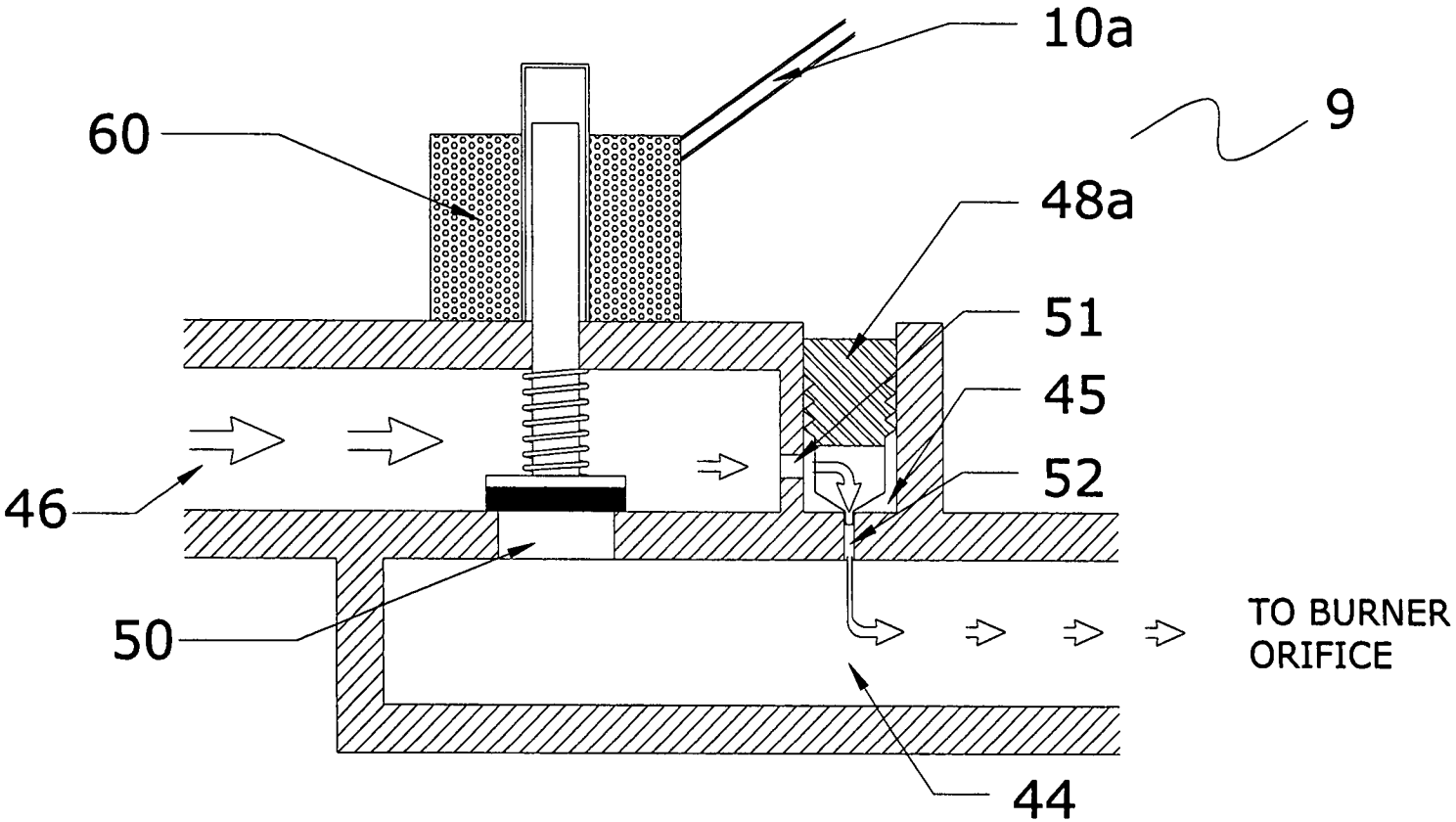
FIG. 6A is a simplified schematic showing the two pathways within a dual stage control valve with the main pathway closed while the by-pass pathway is open for gas passage.

An example of a burner comprises plaques 29 as shown in FIGS. 2 and 2A, laid side by side on top of a burner housing 31 which is usually rectangular having one lateral end open to allow the burner inlet tube 32 to protrude to and be held by the seat bracket 33 after it is placed into the burner compartment 2 as shown in FIGS. 2, 3 and 6A. At the low level heat setting of this heater, plaques arranged in a v-shaped configuration instead of being planarly laid side by side may not work well because the plaques in this case is directed inwards while the flow of the gas-air mixture is directed outwards. At the low setting and when the burner is "on", the internal pressure from the gas-air mixture inside the burner housing is low and any counter pressure that can be brought from the outside could result in getting the flames inside the burner housing, thereby igniting the rich gas-air mixture present inside the burner housing. Insulation is placed around the side peripheral edges of each plaque as they are laid, with each plaque compressed and aligned side by side against each other. The burner 3 has carefully selected ceramic plaques 29 to maximize its efficiency and increase its radiant heat flow. Plaques with high heat output and high thermal shock resistance that could reach approximately 1600 degree Fahrenheit (1600° F.) equilibrium radiant heat output within approximately 60 seconds after igniting the burner 3 is desired. Further, these plaques should be able to stay lit or active even when exposed to gusty wind such as that experienced outdoor. Not all plaques especially those currently used in heaters will deliver these properties. To achieve this, the plaques should have less number of perforations 35, that is, bored pores for gas passages than those currently used for heaters. Plaques with a total pore area of 0.1-0.2 square inch (sq. in.)/sq. in of plaque surface area is recommended. Because there should be less number of perforations than those usually found in the current plaques, the bored pores will have greater diameters than those found in conventional plaques to be within the range of the stated pore area. The size or inside diameter of the individual perforations within the stated given range can be obtained by calculation. With less number of pores, less heat input in terms of British Thermal Unit (Btu) is needed to keep the plaques stably lit thereby allowing the heater to operate at a wider range of temperature. The surface geometry of the plaques also play an important role in keeping the combustion of gases at its surface stable, protected from gusty wind. Plaques having raised surfaces between the perforations 35 provide this protection.

Further, the raised surface 39 should taper into an apex to enable the burner to glow throughout the entire raised surface, that is, including the tip even at the low heat level setting. The dimensions of the raised surfaces can vary so long as their respective tips are able to glow and the number of perforations per square inch are met. Tapered and untapered raised surfaces having a flat top will require a greater amount of heat to allow burning at the flat top surfaces. These will not provide optimum performance because the flat tops usually remain unlit at the low level heat setting. The plaque media through which the perforations for gas passages are bored is recommended to be lightweight and porous. Porous media are desired because they are not only lightweight but also allow the plaques to start glowing within approximately 10 seconds after ignition. An example of a porous media suited for this purpose is bonded refractory ceramic fibre made primarily of aluminum-silicate material. After extensive research and developmental work on several plaques commercially available, certain TENNAGLO® plaques with a porosity of at least about 70% with surfaces having raised square pyramids and bored gas passages, when used with the assembly and construction of the heater described herein, meet the requirement. The bored gas passages 35 are at the corners where adjacent pyramids meet as well as at the sides between the adjacent pyramids, halfway between the corners of the raised pyramidal structure. TENNAGLO® plaques of the T 700 series are capable of supporting a wide range of heat input which is a requirement for a heater with multiple heat level setting such as the claimed invention. As an example, a heater with two heat level settings can have a range of 15,000 to 35,000 Btu at the low heat level setting and a range of 25,000 to 60,000 Btu for the high heat level setting. The amount of heat input is dependent on the size of the area to be heated. The amount and size dimensions of the plaques to use in the heater that can cover the range of heat input desired can be derived by simple calculation based on the size of each plaque and the range of Btu per plaque, data which are supplied by the manufacturer. It is possible, after further experimentations, to find other types of plaques that would perform equivalently as the TENNAGLO® plaques identified above. Also, conical instead of pyramidal raised structure can be expected to work as well. Dome-shaped raised surfaces, while it can work, will not be as efficient due to the absence of an apex, that is, a pointed tip. The burner 3 is placed on the lined compartment 2 with one end of the burner housing 31 opposite the burner inlet tube attached to a step support at the heat shield end 34 of the liner to allow the burner housing 31 to expand and contract during the process of heating and cooling of the plaques 29. The heat shield end of the liner is one that has the bracket 23 with a flat top 25. The inlet tube 32 is located at the side opposite the one attached to the heat shield end and is supported by the seat bracket 33 that has a central opening allowing movement of the burner 3. The burner 3 is inserted into compartment 2 by sliding the inlet tube of the burner at an angle through the openings, 36, 37 of the case divider 30 and insulation board 38 respectively, prior to laying the burner inside compartment 2. The burner inlet tube 32 is located partially inside the burner housing 31 beneath the plaques 29 with one end partially protruding through the open lateral end of the burner housing as shown in FIGS. 2, 4, 4A and 4B. An air venturi bracket 53 is connected to the inlet tube 32 of the burner. An opening 54 on the air venturi bracket fits around an end section of conduit 49 having the orifice 47. The flow of gas through the orifice 47 creates a venturi effect that allows air to flow into the space between the opening 54 of the venturi bracket and the inlet tube 32 of the burner and mix with the gas to obtain the right proportion of air to gas for complete combustion. Extending from the end of the burner inlet tube located inside the burner housing beneath the plaques, is a burner tube (not shown) through which gas is supplied to the burner. A burner cover 6 recommended to be constructed like an eggcrate as shown in FIGS. 1 and 1A, usually made of a metal like aluminum, is placed before the burner to prevent ready access to the burner 3 and the pilot burner of the pilot assembly 7. The burner cover 6 is also designed to reflect radiant heat and deflect wind. The burner 3 is also referred to herein as main infrared burner.

Figure 5A:
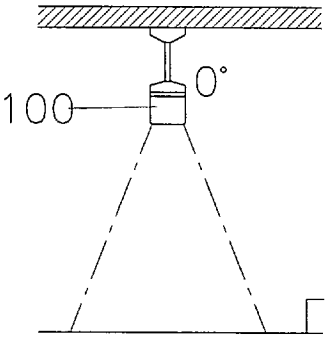
FIGS. 5A and 5B show mounting of the heater at zero degree.
Figure 5B:
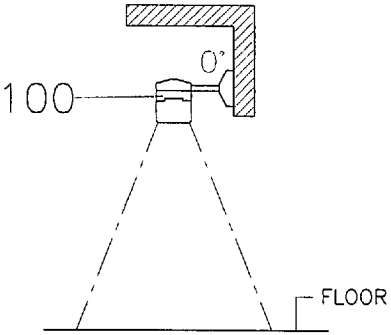
Figure 5C:
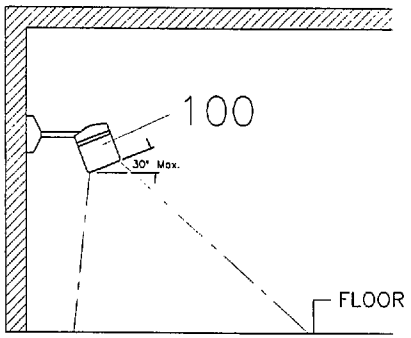
FIG. 5C show mounting of the heater at thirty degrees.
Figure 5D:
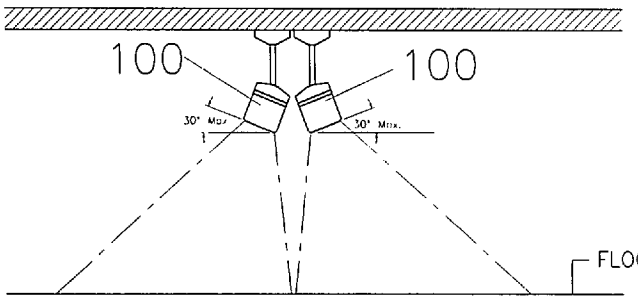
FIGS. 5D and 5E show mounting of multiple heaters at thirty degrees.
Figure 5E:
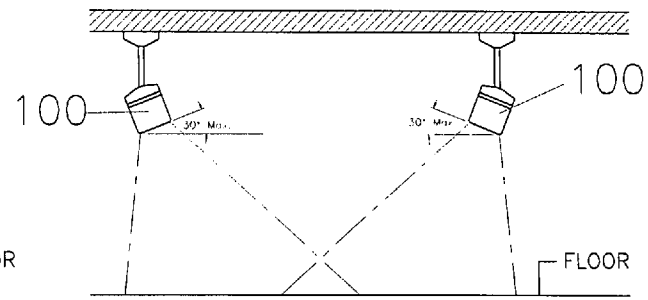

Mounting brackets 40 are generally supplied for attaching the heater to a structure. A mounting bracket in the example shown comprise three major parts: a plate bracket 41; an arm bracket 42; and a structure mounting bracket 43. The plate brackets 41 connects to one side of the arm bracket 42 opposite the structure mounting bracket 43 which as the name denotes, mounts the heater to a structure such as a wall, post, ceiling and the like. The mounting brackets can be designed differently. The mounting brackets are connected to the lateral side panels 12 and 13 of chassis 1. Mounting brackets provide the option of mounting the heater at a zero degree (burner facing the floor) when attached to the ceiling, a beam, a side mount or a post such as shown in FIGS. 5A and 5B. FIG. 5A shows attachment to a beam while FIG. 5B shows attachment to a side mount. It can also be mounted at thirty degrees with reference to the floor to direct the radiant heat towards a desired area in a variety of indoor-outdoor applications as shown in FIG. 5C. The distance between the heater and the floor is usually around nine feet but this distance can vary based on safety considerations or user's desire and application. Multiple heaters with multiple heat level settings can be used to heat a wider area. FIGS. 5D and 5E show examples of two heaters mounted at a ceiling at thirty degrees. FIG. 5D shows a side by side mounting while FIG. 5E shows mounting of two heaters spaced apart directed towards each other.

Welding is an acceptable method for connecting the walls, panels, brackets, liners and other parts of the chassis. Other means of joining the parts may be used so long as it provides strength and durability to the assembled heater. The method of joining or connecting the components of the chassis and the liners as well as the choice of gas and its respective air flow has been designed to minimize warping, discoloration and component overheating. The heater is recommended to be made of rustproof material especially those used outdoors.

Figure 7A:
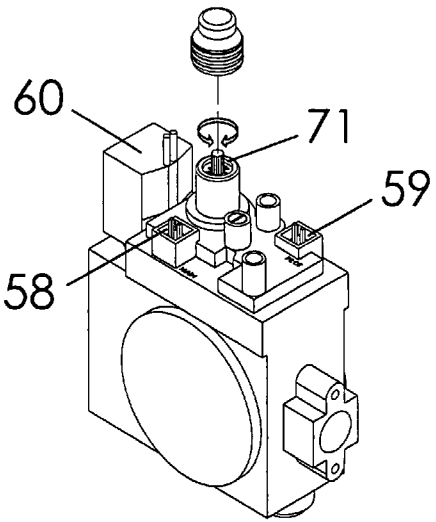
FIG. 7A is a perspective view of the control valve showing the stem converter.
Figure 7B:
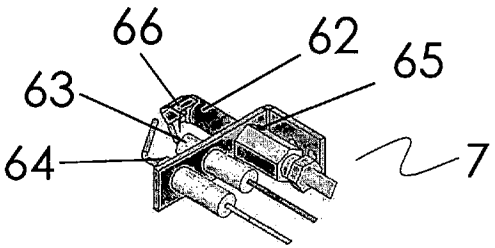
FIG. 7B is an expanded view of the pilot assembly.
Figure 7:
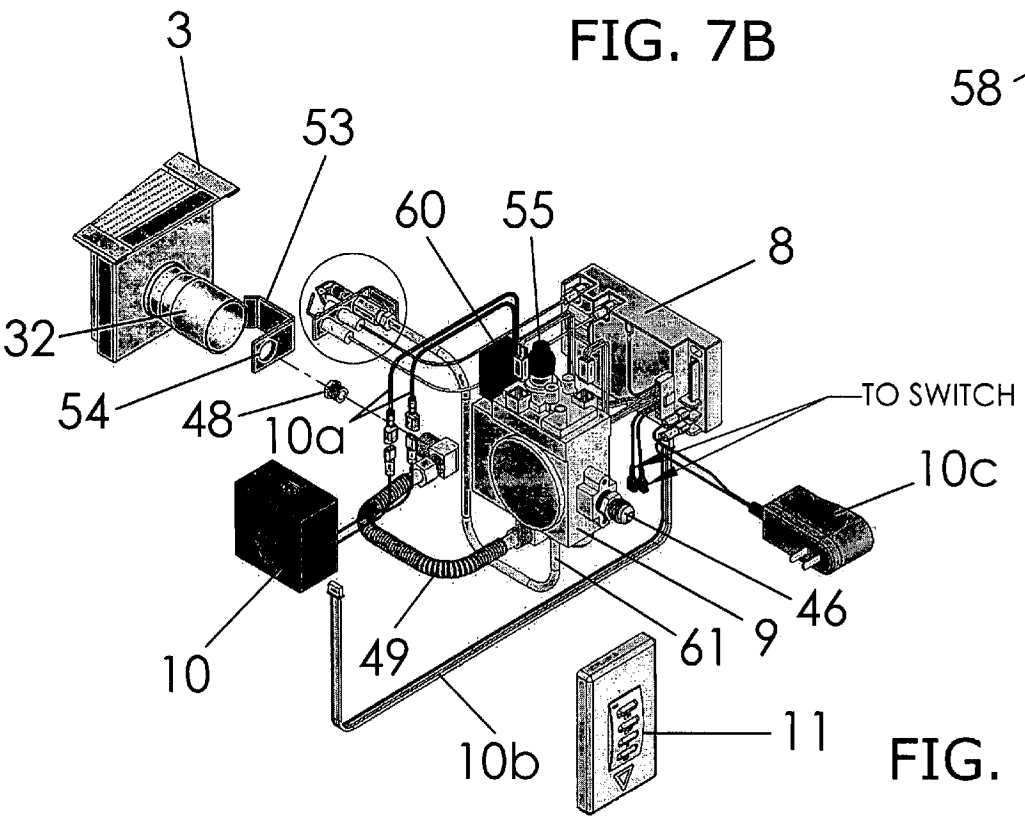
FIG. 7 is a perspective view of the operating system.
Figure 6B:
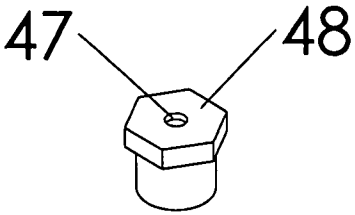
FIG. 6B is a perspective view of an orifice spud.

Choice of the right plaque design and material alone will not be sufficient to provide the flexibility of having more than one heat level settings, for example, a HIGH and a LOW setting on a heater with two heat level settings. The description herein will be detailed for a two heat level setting but multiple heat level settings can be achieved through a modification adopting the teaching of this invention. To achieve two heat level settings, as stated above, the temperature ranges for each heat level setting should be covered within the temperature rating of the plaque. However, this is not enough. This should be combined with a dual stage control valve, that is, a valve having two pathways 44 and 45 for the gas as shown in FIGS. 6 and 6A. With two pathways, one can direct the gas flow to a desired pathway, thereby allowing a user to switch from a high heat level setting using one pathway to a low heat level setting using the other pathway and vice-versa. The first pathway will be identified as main pathway 44 while the second pathway will be identified as by-pass pathway 45. In the example shown, at the HIGH heat level setting, both of the pathways are open, with gas from the by-pass pathway merging into the main pathway as shown in FIG. 6. The gas supplied to the burner 3 is introduced into the gas inlet 46 of the control valve 9 which is directed to either the main pathway 44 or the by-pass pathway 45 or to both. As shown in FIGS. 6, 6B and 7, the main pathway 44 flows through conduit 49 having an orifice 47 on an orifice spud 48 connected to one end of the conduit 49 located opposite the end connecting to the control valve 9. The orifice 47 leads to the burner inlet tube 32. For a HIGH heat level setting, only the orifice 47 determines the amount of input gas into the burner 3. For example, if the HIGH heat level setting is desired to have a heat input of approximately 37,500 Btu, an orifice rated for that input is used. For a LOW heat level setting, the opening 50 of the main pathway is blocked as shown in FIG. 6A, consequently restricting the flow of gas only through the opening 51 of the by-pass pathway 45. A second orifice 52 on the second orifice spud 48*a*, as shown in FIG. 6A, on the by-pass pathway determines the amount of input gas even if the same gas flows through orifice 47 leading to the burner inlet 32 because the diameter of orifice 52 is smaller than the diameter of orifice 47. The size of the orifice determines the amount or volume of gas introduced to the burner inlet 32. For example, if a LOW heat level setting is desired at approximately 25,000 Btu, an orifice rated for this input is used. The diameter of the orifice is rated according to the heat input (Btu/hour) which can be obtained from the Gas Engineer Handbook. Inventor here used Table 12-89b, Orifice Capacities, Btu/hr. of the First Edition, page 12/202, published by Industrial Press, Inc., New York for sizing the orifices. The diameter of the pathways and the material from which it is made can vary but stainless steel is a good material to use because it is non-corrosive and heat resistant. Other materials that possess the same properties can be used. The pathways are dimensioned to allow a good flow of the gases and this can be determined through experimentation. FIGS. 7, 4 and 4A show how the orifice connects to a pathway using a fitting.

It is desirable for the control valve 9 to have a gas converter to enable the heater to operate with either natural gas or liquid propane. These two fuels are referred to herein simply as gas unless differentiation is required. Since liquid propane has at least twice the heating value of natural gas, in order to achieve the same or comparable heat input on the burner for both gases, the diameter of the orifices 47 and 52 when natural gas is used, should be larger than that used for liquid propane. This data is included in Table 12-89b, Orifice Capacities, cited above. Aside from changing the diameter of the orifice to adopt to the type of gas used, the converter stem 71 located underneath the rubber cap 55 of the control valve 9 shown in FIGS. 7 and 7A is pushed and turned to the desired gas setting, NG or LP. The converter stem ensures that the control valve delivers the desired manifold pressure. If natural gas is used, an inlet pressure of at least approximately 6 inches of water column with a manifold pressure of approximately 5 inches water column is used. For liquid propane, the inlet pressure is approximately 11 inches of water column pressure with a manifold pressure of approximately 10 inches of water column. With these level of pressures, gas does not flow through the inherent openings within the porous media of the plaques but rather, gas flows and burns only through the perforations 35, the bored gas passages. The inlet and manifold pressures are determined experimentally according to the desired heat input on the burner.

FIGS. 2, 4A and 4B show the dividers 30 and 67 inside compartment 4 separated from the burner compartment 2 by the case divider 30 with a door stop 56 (see FIGS. 2 and 4). FIG. 4A shows the assembly unobstructed by the case divider, the door stop and the flue kicker 70 showing the interconnection of the burner and the operating system through the third compartment 38. The broken lines on FIG. 4A show the place where the case divider 30 with the door stop 56 and the seat bracket 33 reside. It also shows the components blocked in view by the flue kicker. The insulation board along with the case divider protects the operating system from heat emanating from the pilot assembly and the burner. The control module 8, control valve 9 and the power source 10 shown as a battery pack attaches to the interior walls of compartment 4. The operating system 5 is properly grounded to the chassis 1. Compartment 4 as shown in FIGS. 2 and 4B has an access door 57 having a plurality of holes 69 to allow air into the operating system. The compartment divider 67 as shown in FIGS. 4A and 4B is mounted between the lateral side panel 13 and the case divider 30. The compartment divider as stated above is shaped in the same way as the case divider 30.

Figure 7C:
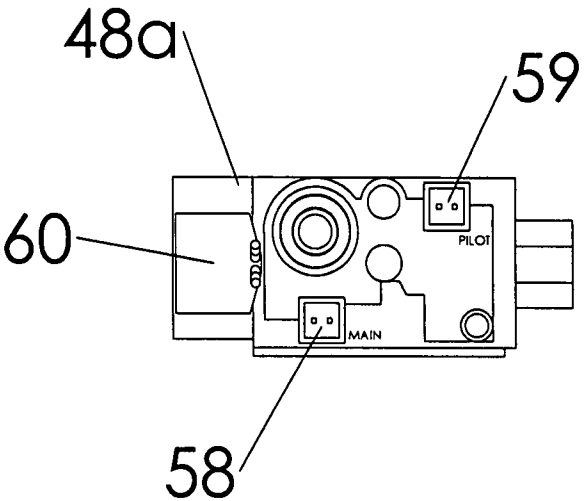
FIG. 7C is a top view of the control valve.

The example of the illustrated heater here has two methods of actuating the operation, one by a wireless remote control 11 and the other by an external switch (not shown) which is connected to the two lead wires from the control module 8. Prior to initial usage, the remote control 11 is synchronized with the control module 8 as known in the art. The control module 8 is electrically connected to the control valve 9 having a main valve connector 58 and a pilot light connector 59 as shown in FIG. 7C. A battery pack 10 with two sets of wiring connections, 10*a* and 10*b* connects one, 10*a*, to an external solenoid 60 of the control valve 9 which provides power to the control valve and connects the other, 10*b* to the control module 8. The wiring to the control module is recommended to be a wiring harness.

Power is supplied to the operating system by a battery pack 10 and/or from a standard electrical outlet using an AC adapter 10*c* connecting to a standard wall outlet. Use of the battery instead of an AC adapter do away with the need to have an electrical installation to operate the heater. Another unique feature of this heater is the ability to be fully powered by a battery because the control valve 9 used in this heater operates with a 6 volts battery or 4 double A batteries of 1.5 volts each. A voltage greater than 6, for example, a 9 volt battery can be used and still maintain a reasonably sized heater if the external solenoid 60 is modified. Use of a 12 volt battery will be too bulky to fit into the compartment 4. It is possible to have a control valve that can operate with 3 volts. When a user chooses to power the heater through the AC adapter 10*c* connected to the control module 8, consumption of energy from the battery pack 10 is minimized. The battery pack is used as a power back up when there is a power failure from the AC adapter used to operate the heater.

The operation of the heater starts when the control module 8 receives a signal for ignition by triggering the remote control or the external switch to the 'ON' position. Once the heater is operating, the control module 8 will send a signal to the control valve 9 which will allow the gas to flow through conduit 61 (not through conduit 49) to the pilot burner 62 in the pilot assembly 7. The pilot assembly 7 comprises a pilot burner 62 supplying gas to keep the pilot light burning, a pilot spark electrode 63 to initiate or ignite a pilot flame, and a pilot flame rectifier sensor 64 as shown in FIG. 7B. Simultaneous to the start of gas flow through conduit 61, the control module 8, sends a signal to the spark electrode 63 to ignite a flame at the pilot burner 62. The pilot assembly also by its design and construction, has a venturi 65 to allow air and gas to mix and burn at the pilot burner. The pilot burner 62 has a gas collector hood 66 that splits the spark generated flame, one towards the pilot flame rectifier sensor 64 and the other towards the main infrared burner 3. If the flame rectifier sensor 64 does not detect a flame within 60 seconds after turning the system 'ON', the control module will signal the control valve to shut off the gas flow and cancel the ignition process. If the pilot flame rectifier sensor 64 of the pilot assembly 7 detects a flame, the control module 8 signals the main burner actuator located inside the control valve 9 to open the gas flow through conduit 49 to the main infrared burner 3. As a safety feature, the control module 8 has a temperature sensor which will shut its operation down when the temperature of its immediate surroundings exceed a certain level, usually at approximately 170 degrees Fahrenheit. This temperature setting is at the discretion of the manufacturer based on the maximum temperature tolerance of the other components of the system. Once the gas enters the burner housing 31, the pilot flame will lit the plaques 29 of the burner 3. The control valve 9 automatically ignites at the HIGH heat level setting even if the last setting on the heater on a prior use was at the LOW heat level setting. To convert to a LOW heat level setting, the main pathway has to be blocked to allow gas to flow only through the by-pass pathway as described above. The heater is shut off when the activator 11 such as the remote control or the external switch is placed to the 'OFF' position.

While the embodiments of the present invention have been described, it should be understood that various changes, adaptations, and modifications may be made therein without departing from the spirit of the invention and the scope of the claims.

What is claimed is:

1. An indoor-outdoor gas infrared heater having one or more heat level settings, comprising:

a chassis having a burner compartment housing a burner in a burner housing, the burner having ceramic plaques with a plurality of perforations having a total pore area of 0.1-0.2 square inches per square inch of plaque surface area and raised surfaces between the perforations, the raised surfaces tapering into an apex, the burner housing having one lateral end open to allow a burner inlet tube to protrude and plaques having insulation placed around the side peripheral edges of each plaque laid planarly side by side on top of the burner housing, the burner housing attached only to a heat shield end of the chassis and the burner inlet tube of the burner housing located opposite the heat shield end left unattached but supported by a seat bracket having a central opening allowing movement of the burner inlet tube therethrough to allow the burner housing to contract and expand during the process of heating and cooling of the plaques;

an operating system compartment separated from the burner compartment housing an operating system including a control module electrically connected to a control valve having a main valve connector to the burner and a connector to a pilot assembly, a power source and an activator for triggering the heater, the control valve operating at a low voltage having multiple pathways with each pathway including an orifice having a diameter rated according to a heat input on the heater, the orifices controlling the amount supplied and designating the type of gas flowing into the burner at a flow rate for a designated heat level setting, the control valve including a converter stem to ensure delivery of a correct manifold pressure by the control valve for the type of gas used; and, a compartment divider further dividing the operating system compartment to result in a third burner venturi compartment comprising a flue kicker placed underneath the inlet tube of the burner having one end attached beneath a seat bracket holding the inlet tube of the burner and another end attached to the compartment divider, the compartment divider shielding the control module, control valve, power source and activator on the operating system compartment from heat coming from the burner inlet tube of the burner housing protruding from the burner compartment when the burner is turned "off" just after usage.

2. The gas infrared heater of claim 1 wherein the length of the heater is greater than 48 inches.

3. The gas infrared gas heater of claim 1 wherein the operating system compartment has an access door with a plurality of holes to allow air into the operating system.

4. The gas infrared heater of claim 1 wherein the chassis is bordered by two lateral side panels and two longitudinal side panels with a bottom panel connected to the lateral side panels having louvers to allow air to ventilate the heater, the connection of the bottom panel with the lateral sides resulting into a flue.

5. The gas infrared heater of claim 4 further comprising stiffeners placed on the longitudinal side panels opposite a front opening for the burner to provide extra strength and support to the chassis.

6. The gas infrared heater of claim 1 wherein the burner compartment is lined, the liner covering at least ¾ of the burner housing providing protection to the chassis from the heat of the burner.

7. The gas infrared heater of claim 1 wherein the ceramic plaques are of high porosity bonded refractory ceramic fibre made primarily of an aluminum-silicate material supporting a wide range of heat input for the heat level setting of the heater, lightweight and glows within 10 seconds after ignition.

8. The gas infrared heater of claim 1 wherein the ceramic plaques have a high heat input and a high thermal shock resistance reaching approximately 1600 degrees Fahrenheit equilibrium radiant heat output within approximately 60 seconds after ignition of the burner.

9. The gas infrared heater of claim 1 wherein the raised surfaces on the ceramic plaques is pyramidal or conical in shape.

10. The gas infrared heater of claim 1 wherein a low level heat setting has a range of 15,000 to 35,000 Btu and a high heat level setting has a range of 25,000 to 60,000 Btu on a heater with a two heat level settings.

11. The gas infrared heater of claim 1 wherein the heater operates with either natural gas or liquid propane.

12. The gas infrared heater of claim 1 wherein the manifold pressure for natural gas is approximately 5 inches of water column and manifold pressure for liquid propane is approximately 10 inches of water column.

13. The gas infrared heater of claim 1 wherein the control valve operates with approximately 3 to approximately 9 volts of battery power thereby allowing the heater to be powered solely by a battery, by a standard electrical power outlet backed up by battery power or by standard electrical power.

14. The gas infrared heater of claim 1 wherein the activator is a wireless remote control or an external switch.

15. The gas infrared heater of claim 1 wherein the control module has a temperature sensor to shut down the operation when the surrounding temperature exceeds a set temperature.

16. The gas infrared heater of claim 1 wherein the flue kicker is pan-like having flared up longitudinal sides to direct the flow of hot gas-air mixture coming from the burner housing upwards.

17. An indoor-outdoor gas infrared heater with multiple heat level settings operating on two types of gas, comprising:

a chassis having a lined burner compartment housing a burner in a burner housing, the burner having ceramic plaques made primarily of aluminum-silicate material supporting a wide range of heat input for the multiple heat level settings, the plaques having a plurality of perforations with a total pore area of 0.1-0.2 square inches per square inch of plaque surface area and having raised surfaces, pyramidal or conical in shape tapering into an apex, between the perforations, the burner housing having one lateral end open to allow a burner inlet tube to protrude and plaques having insulation placed around the side peripheral edges of each plaque laid planarly side by side on top of the burner housing, the burner housing attached only to a heat shield end of the chassis and the burner inlet tube of the burner housing located opposite the heat shield end left unattached but supported by a seat bracket having a central opening allowing movement of the burner inlet tube therethrough to allow the burner housing to contract and expand during the process of heating and cooling of the plaques; and, an operating system compartment separated from the burner compartment housing an operating system including a control module electrically connected to a control valve having a main valve connector to the burner and a connector to a pilot assembly, a power source and an activator for triggering the heater, the control valve operating at a low voltage having multiple pathways with each pathway including an orifice having a diameter rated according to a heat input on the heater, the orifices controlling the amount supplied and designating the type of gas flowing into the burner for a designated heat level setting, the control valve including a converter stem to ensure delivery of a correct manifold pressure by the control valve for the type of gas used.

18. The gas infrared heater of claim 17 wherein the control valve operates with approximately 3 to approximately 9 volts of battery power thereby allowing the heater to be powered solely by a battery, by a standard electrical power outlet backed up by battery power or by standard electrical power.

19. The heater of claim 17 wherein the activator is a wireless remote control.

20. A process of operating an indoor-outdoor gas infrared heater with multiple heat level settings having a burner comprising ceramic plaques with raised surfaces tapering into an apex between perforations wherein gas flows into, a pilot flame rectifier sensor shutting the gas flow when the pilot fails to detect a flame within 60 seconds after the activator is placed to the 'ON' position and an operating system including a control module electrically connected to a control valve operating at a low voltage having a main valve connector to the burner, a connector to a pilot assembly and multiple pathways with each pathway supplying gas to the burner at a flow rate for a designated heat level setting, a power source and an activator for triggering the heater, the heater shutting off when the temperature of the control module exceeds a designated temperature, comprising:

triggering the heater by placing the activator to an 'ON' position;

receiving a signal for ignition by the control module of the heater;

sending the signal to the control valve by the control module electrically connected to the control valve;

allowing a gas to flow through a conduit to a pilot burner in the pilot assembly by the control valve;

sending a signal to a spark electrode of the pilot assembly to ignite a flame at the pilot burner simultaneous to the control valve allowing gas to flow through the conduit to the pilot burner;

mixing the gas with air and allowing this to burn at the pilot burner;

splitting the flame at the pilot burner by a gas collector hood on the pilot burner, one towards a pilot flame rectifier sensor and the other towards a main infrared burner;

detecting a flame by the pilot flame rectifier sensor and signaling a main burner actuator inside the control valve to open the gas flow through a conduit of the main infrared burner;

lighting the ceramic plaques on the burner after the burner receives the flow and type of gas designated for a high heat level setting;

adjusting the heat level setting to another heat level setting or maintaining the high heat level setting; and shutting the heater off when heating is no longer needed by placing the activator to an 'OFF' position.

* * * * *